US005141227A

United States Patent [19]

Flamm

[11] Patent Number: 5,141,227

[45] Date of Patent: Aug. 25, 1992

[54] PREFABRICATED STRINGING FOR A SPORTS RACKET

[76] Inventor: Klaus Flamm, Kalkstr. 1, D-4030 Ratingen 4, Fed. Rep. of Germany

[21] Appl. No.: 536,606

[22] PCT Filed: Nov. 8, 1989

[86] PCT No.: PCT/EP89/01332

§ 371 Date: Jul. 24, 1990

§ 102(e) Date: Jul. 24, 1990

[87] PCT Pub. No.: WO90/05002

PCT Pub. Date: May 17, 1990

[30] Foreign Application Priority Data

Nov. 9, 1988 [DE] Fed. Rep. of Germany ... 8813991[U]
Feb. 24, 1989 [DE] Fed. Rep. of Germany ... 8902213[U]

[51] Int. Cl.[5] ..... A63B 51/02

[52] U.S. Cl. ..... 273/73 D; 273/73 A

[58] Field of Search ..... 273/73 R, 73 A, 73 D, 273/73 E, 73 L, 29 B, 73 B

[56] References Cited

U.S. PATENT DOCUMENTS

| | | | |
|---|---|---|---|
| 2,156,092 | 4/1939 | Johnson | 273/73 A |
| 3,834,699 | 9/1974 | Pass | 273/73 D |
| 3,966,207 | 6/1976 | Pass | 273/73 D |
| 4,118,029 | 10/1978 | Septier | 273/73 D |
| 4,149,722 | 4/1979 | Yager | 273/73 D |
| 4,741,531 | 5/1988 | Szedressy | 273/73 D |

FOREIGN PATENT DOCUMENTS

| | | | |
|---|---|---|---|
| 8103431 | 12/1981 | European Pat. Off. | 273/73 R |
| 0133165 | 2/1985 | European Pat. Off. | 273/73 A |
| 8801186 | 2/1988 | European Pat. Off. | 273/73 D |
| 8901809 | 3/1989 | European Pat. Off. | 273/73 D |
| 2831288 | 2/1980 | Fed. Rep. of Germany | 273/73 D |
| 2598323 | 11/1987 | France | 273/73 D |
| 25019 | of 1912 | United Kingdom | 273/73 D |
| 300700 | 11/1928 | United Kingdom | 273/73 R |
| 2185411 | 7/1987 | United Kingdom | 273/73 A |

*Primary Examiner*—George J. Marlo
*Assistant Examiner*—Sebastiano Passaniti
*Attorney, Agent, or Firm*—Chilton, Alix & Van Kirk

[57] ABSTRACT

The invention relates to stringing for a racket for tennis, badminton or the like, consisting of individual, in each parallel transverse and longitudinal strings which are crossed in the manner of a linen weave to give a ready-made network and at the same time arranged spaced apart from one another and which have outwardly protruding, free, cut-off ends for individual fastening in a racket frame and are held in their mutual position by a removable aligning device.

14 Claims, 3 Drawing Sheets

PREFABRICATED STRINGING FOR A SPORTS RACKET

BACKGROUND OF THE INVENTION

1. Field of the Invention

The invention relates to stringing for a racket for tennis, badminton or the like.

2. Description of the Prior Art

When stringing rackets for tennis, badminton or the like, use is made of a string cord which is successively passed through the holes of the racket frame. Each individual section or length of string between two holes is tightened individually by means of tightening devices, temporarily held firmly until the cord is passed over the frame on the outside into the next hole, and then released. In this process, the racket is frequently turned so that the tightening device can be attached. In the end, the entire stringing consists of one or perhaps two string cords. When the longitudinal strings have been fitted and tightened, the transverse strings must be passed through alternately over and under the longitudinal strings and likewise individually tightened. Altogether, this takes a relatively long time.

It is furthermore known from published German Patent Application 2,605,638, to use ready-made stringing, in which one or two string cords are fitted directly as a preassembled network. The ends of each of the adjacent strings are brought together and form a loop which is suspended in the racket frame by being pushed through an allocated hole and held either by a securing string extending around the frame, or the adjacent loop. This ready-made stringing can be used, however, only if the dimensions thereof exactly match those of the frame. In addition, it is unavoidable here that the strings assume, as a result of the loops, a more zigzag pattern at least during use and thereby might also lose tension. For permanently fastening the strings in the racket frame with these known types of stringing, the two free ends of each of the string cords are knotted.

From European Patent 0,260,671 stringing is known in the form of individual strings which are successively fitted to the racket frame and tightened. These individual strings are each held in the racket frame by means of rivet sleeves, rivet heads bearing against the outer holes. The securing of the ends of a string to the frame can also be effected by means of a wedge arrangement, as is known, for example, from published German Patent Application 3,034,285. However, a lot of time is required to fit and tighten the individual strings, and, as a result of passing the strings over strings which are already tightened, the process of stringing is awkward even for craftsmen.

SUMMARY OF THE INVENTION

The object of the invention therefore is to provide stringing which is suitable for any racket frame and considerably simplifies the work process on stringing.

In accordance with the present invention, a ready-made network comprised of two generally transversely oriented arrays of parallel strings is provided. This network permits stringing of a racket head, as in the case of strings fitted individually to the racket frame, but without the need for an elaborate threading-through of the individual strings. In the present invention, the strings for the stringing process are held in their predetermined position with respect to one another by means of an aligning device. In order to string a racket, the ready-made network can be brought into the racket head, it being possible for the free string ends to be passed through the respective associated holes of the racket frame. The strings can then be tightened individually or in groups. Thus, up to the stringing itself no forces are transmitted to the frame itself, as a result of which the latter is not deformed. The individual strings in the tightened state are secured in the holes of the frame by means of a wedge arrangement for instance, as is known from published German Patent Application 3,034,285. After loosening the tightener, the protruding string ends are cut off and the aligning device is preferably removed if it has not become detached independently.

The aligning device employed for the strings may be an adhesive film which extends over at least part of the network and adheres to the strings in this region. A plastic film or sheet having a grooved network which receives the strings may also be provided as an aligning device. As a further aligning device, use may be made of a fixing device for the individual peripheral crossing points of the strings of the network. For this purpose connecting elements, for example grippers, which can be placed on the crossing points may be provided. With these grippers, an additional fixing of the crossing points in position may be achieved by lining up the grippers along a rail. Four rails linked via their corner points are preferably provided for the four sides of the network. The fixing of the peripheral crossing points may, however, also be accomplished by means of inserted threads in the manner of a seam, it being possible to remove this seam easily by severing one thread. An aligning device of this type fixes the predetermined position of transverse and longitudinal strings even when the ready-made network is subjected to compression and/or stretching, as a result of which packaging or storage of the network is simplified. The aligning device ensures, after this temporary deformation, a return of the laid network to its form for fitting in position.

BRIEF DESCRIPTION OF THE DRAWINGS

The invention will be explained in greater detail below with reference to the exemplary embodiments illustrated in the attached drawings.

DESCRIPTION OF THE DISCLOSED EMBODIMENTS

Figure 1:
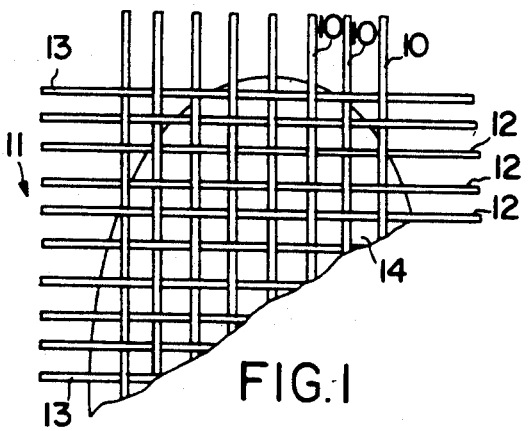
FIG. 1 shows, in plan view, ready-made stringing having a first embodiment of an aligning device.

The stringing shown in FIG. 1 consists of a first array of substantially parallel strings 10, hereinafter the "longitudinal" strings, and a second array of substantially parallel strings 12. The strings 12, hereinafter the "transverse" strings, are oriented generally transversely with respect to the strings 10. Thus, the strings 10 and 12 are arranged spaced apart from one another like warp and weft of a woven fabric in linen weave and form a ready-made network 11. In this arrangement, the longitudinal and transverse strings 10, 12 posses free, outwardly protruding ends 13 of a length such that trouble-free tightening is made possible. The stringing is of a size adaptable to the various racket sizes and can be manufactured inexpensively on machines similar to wire gauze looms.

An aligning device 14 is provided (cf. also FIG. 2 and FIG. 3) at least over part of the area in which the longitudinal strings 10 and the transverse strings 12 cross. This aligning device 14 preferably remains in place until the individual strings 10, 12 of the network 11 have been threaded through holes in a racket frame and optionally until the string ends have been secured, to the frame. The aligning device 14 is preferably designed so that it can be torn off.

Referring to FIG. 1, the aligning device 14 is, in a first exemplary embodiment, of flat construction, in the form of an adhesive film which covers at least part of the network, it being possible optionally to arrange a protective film on the side opposite the holding device 14.

Figure 2:
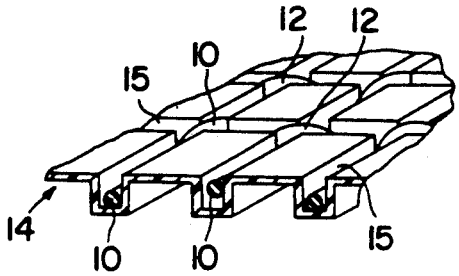
FIG. 2 shows, in perspective and in detail, a second embodiment of an aligning device for the stringing of FIG. 1.
Figure 3C:
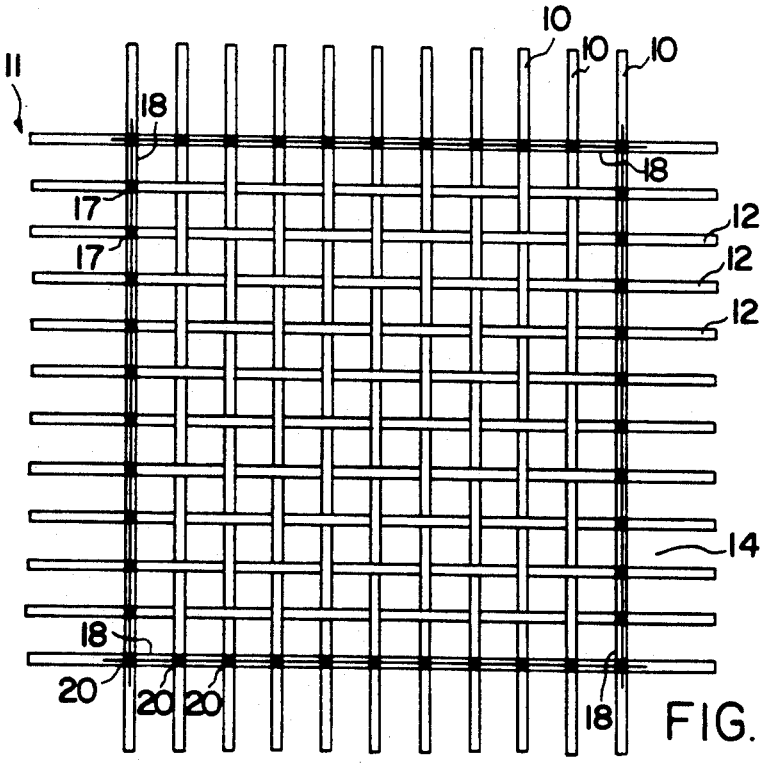
FIGS. 3*a* to 3*c* show, in plan view, ready-made stringing having a third embodiment of an aligning device.

As shown in FIG. 2, the aligning device 14 may, according to a second embodiment, be constructed as a relatively flexible plastic film (or optionally plastic sheet) which is provided with a network of impressed grooves 15 corresponding to the network 11 of the stringing. The grooves 15 have a width corresponding to the width of the longitudinal and transverse strings 10, 12 and a depth at least equal to twice the thickness of the longitudinal and transverse strings 10 and 12, so that the stringing is completely received by the grooves 15 and prevented from falling out. In this case, too, a cover may optionally be provided for the grooves 15.

If the stringing is too large for a racket, corresponding longitudinal or transverse strings 10, 12 can be readily removed. In the event that the stringing is too small for a racket, an additional string 10 or 12 can also readily be inserted. Since the longitudinal strings 10 and also the transverse strings 12 in each case have the same length, which is somewhat greater than the longitudinal or transverse extent, respectively, of the frame, relatively short lengths of string material can also be used, which, when employing catgut as the string material, leads to a more efficient utilization of this material.

Figure 3A:
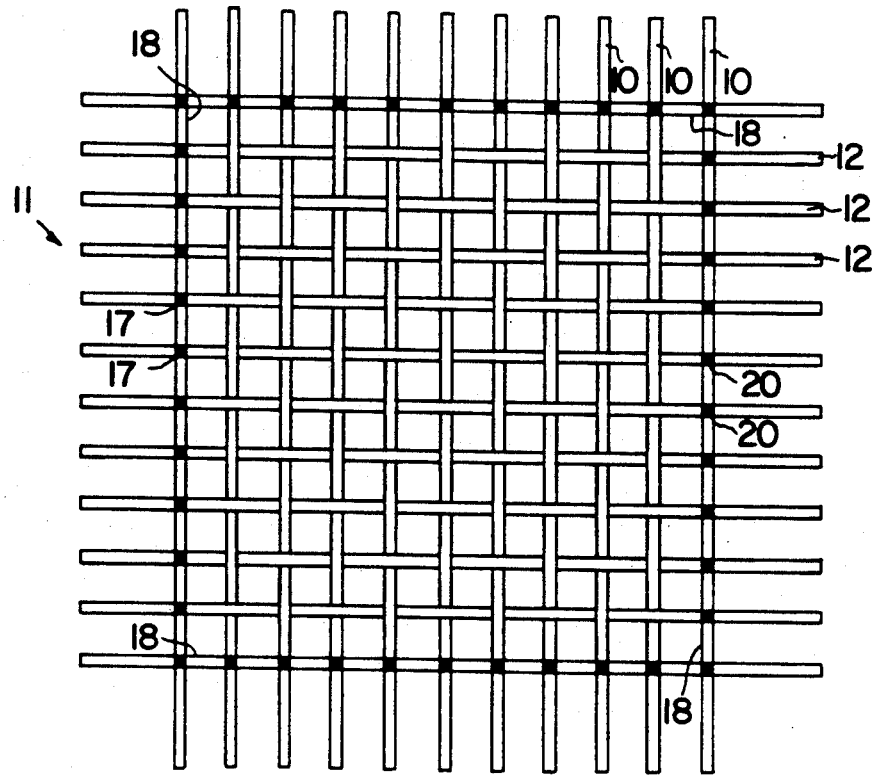
Figure 3B:
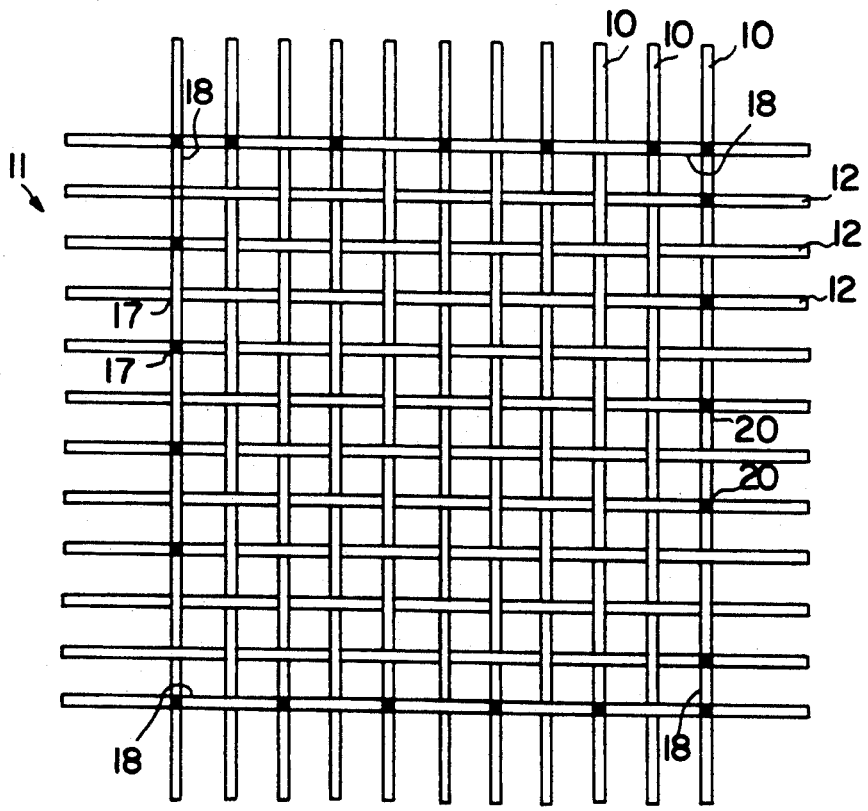

According to a third exemplary embodiment, the aligning device 14 may comprise attachable distance pieces which are provided, for example, on a continuous ring. In FIG. 3*a*, these distance pieces are constructed as connecting elements 20 which are placed on individual peripheral crossing points 17 of the strings 10, 12 in order to fix the relative position of the strings 10, 12 by pressing them against one another in the respective crossing point 17. This is intended in particular to prevent a fraying and/or a network-destroying slippage of the strings 10, 12. The connecting elements 20 may be placed at varying intervals only on specific crossing points 17 in the peripheral region of the network 11, but then in accordance with FIG. 3*b* preferably in the corner regions 18 of the network 11. As shown in FIG. 3*a*, the connecting elements 20 are, however, preferably arranged on all crossing points 17 along the outer periphery of the network 11.

Furthermore, the connecting elements 20 are preferably linked to one another, and in particular along one side of each network 11, so that, once selected, the relative position of the peripheral crossing points 17 can be obtained again even after a deformation of the network 11. As shown in FIG. 3*c*, the connecting elements 20 are for this purpose lined up along a rail 30 which spatially fixes the connecting elements 20 in their mutual position, which is preferably effected with a clearance of movement.

Figure 4:
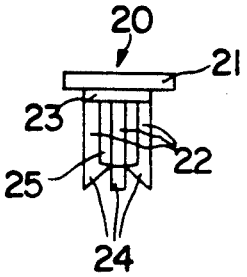
FIG. 4 shows, diagrammatically in side view, a connecting element of the aligning device according to FIG. 3.

FIG. 4 shows an embodiment of an individual connecting element 20 which is constructed as a gripper which embraces the respective crossing point 17. This gripper comprises a head part 21, on which arms 22 are resiliently formed. The head part 21 is preferably constructed with a neck 23 of smaller diameter, as a result of which suspension of the grippers in the rail 30 is made possible. The number of the arms 22 is at least two, but preferably four. In this arrangement, the arms 22 are arranged spaced apart from one another, and to be precise in such a way that one string 10, 12 in each case, of varying thickness, is able to pass between each two arms 22. The arms 22 are in each case equipped with mutually aligned hooks 24 at an end opposite the head, part 21. These hooks 24 in part define a gripper or string receiving space 25. As clearly shown in FIG. 4, the hooks 24 comprise wedge-shaped projections of the arms 22. These projections have inwardly extending shoulders at their junction with the ends of the arms. These shoulders define a first end of the space 25, the opposite end of space 25 being defined by the neck 23.

Figure 5:
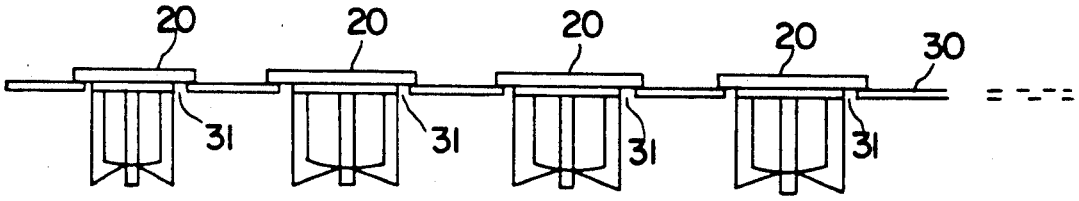
FIG. 5 shows, diagrammatically in side view, a plurality of connecting elements according to FIG. 4 along a rail.

FIG. 5 shows the above-described connecting elements 20, which are suspended, spaced apart from one another, in a strip-shaped rail 30. For this purpose, the rail 30 has perforations 31, the diameter of which is smaller than the diameter of the head part 21 but greater than the diameter of the neck 23. As a result, the connecting element 20 is spatially fixed inside the perforation 31, but with a clearance of movement. The perforations 31 are arranged along the rail 30 at intervals corresponding to the chosen distances between each two longitudinal or transverse strings 10, 12.

According to a further exemplary embodiment (not shown), the connecting elements 20 may be guided in the manner of suspension rollers in a rail so as to be able to be locked and displaced to and fro, in order to be able to set variable distances between each two longitudinal or transverse strings.

The above-described embodiments are only intended as examples. Within the context of the patent claims defining the invention, a person skilled in the art may envisage modifications, additions and sub-combinations on the basis of his specialist knowledge.

I claim:

1. A prefabricated stringing for a sports racket comprising:

a first array of generally parallel strings;

a second array of generally parallel strings, the strings of the second array being oriented substantially transversely with respect to the strings of the first array, the strings of the first and second arrays being interwoven to define a network of crossed strings wherein adjacent parallel strings are spaced apart from one another, the strings of said network having outwardly protruding free ends for individual fastening in a racket frame; and aligning means for maintaining the orientation and spacing of the strings of the network prior to the insertion thereof in a racket frame, said aligning means comprising a plurality of individual connecting elements, said connecting elements establishing contact between a string of each of said arrays at points where said strings of said first and second arrays cross whereby relative movement between the contacting strings is prevented when said aligning means are operatively attached to said network, said connecting elements each comprising:

a head portion; and a plurality of resilient arms extending from said head portion, said arms having free ends and the strings between which contact is to be established passing between said free ends, whereby the strings are captured at their crossing point in a space defined by said head portion and said arms.

2. The stringing of claim 1 wherein the network has a generally rectangular shape having peripheral corners and said connecting elements are provided at peripheral string crossing points located at the corners of said network.

3. The stringing of claim 1 wherein one of said connecting elements is provided at each peripheral crossing point of the network.

4. The stringing of claim 1 wherein said arms are provided, on the free ends thereof, with generally wedge-shaped projections, said projections defining shoulders which extend inwardly toward a cooperating shoulder on an oppositely facing arm, said shoulders defining means for capturing said strings said first and second arrays between said head portion and said shoulders.

5. The stringing of claim 4 wherein said connecting elements each include four of said arms.

6. The stringing of claim 5 wherein the network has a generally rectangular shape having peripheral corners and said connecting elements are provided at peripheral string crossing points located at the corners of said network.

7. The stringing of claim 5 wherein one of said connecting elements is provided at each crossing point of the network of the strings of the first and second arrays around a periphery.

8. The stringing of claim 4 wherein the network has a generally rectangular shape, said connecting elements are disposed along at least a first peripheral side of the network at peripheral string crossings, and said stringing further comprises:

rail means interconnecting said connecting elements which are disposed along said first peripheral side of the network.

9. The stringing of claim 8 wherein said connecting elements are movable relative to said rail.

10. The stringing of claim 9 wherein said connecting elements include four of said arms.

11. The stringing of claim 1 wherein said connecting elements each include four of said arms.

12. The stringing of claim 1 wherein the network has a generally rectangular shape and the stringing further comprises:

means interconnecting said connecting elements which are disposed along at least a first peripheral side of network at the peripheral string crossings.

13. The stringing of claim 12 wherein said interconnecting means comprises a rail.

14. The stringing of claim 13 wherein said connecting elements are movable relative to said rail.

* * * * *